US007073697B2

(12) United States Patent
Lin

(10) Patent No.: US 7,073,697 B2
(45) Date of Patent: Jul. 11, 2006

(54) TRIGGER SWITCH STRUCTURE OF NAIL DRIVER

(76) Inventor: Chien-Chuan Lin, 235 Chung-Ho Box 8-24, Taipei (TW)

( * ) Notice: Subject to any disclaimer, the term of this patent is extended or adjusted under 35 U.S.C. 154(b) by 29 days.

(21) Appl. No.: 10/916,584

(22) Filed: Aug. 12, 2004

(65) Prior Publication Data

US 2006/0032885 A1 Feb. 16, 2006

(51) Int. Cl.
*B21J 15/28* (2006.01)

(52) U.S. Cl. ..... 227/8; 227/130

(58) Field of Classification Search ..... 227/8, 227/130

See application file for complete search history.

(56) References Cited

U.S. PATENT DOCUMENTS 3,612,379 A * 10/1971 Panock ..... 227/8
3,964,659 A * 6/1976 Eiben et al. ..... 227/8
4,629,106 A * 12/1986 Howard et al. ..... 227/8
6,543,664 B1 * 4/2003 Wolfberg ..... 227/8
6,659,324 B1 * 12/2003 Liu ..... 227/8
6,857,547 B1 * 2/2005 Lee ..... 227/8
6,860,416 B1 * 3/2005 Chen ..... 227/8
6,929,165 B1 * 8/2005 Chen et al. ..... 227/8
6,948,646 B1 * 9/2005 Huang ..... 227/8
6,953,137 B1 * 10/2005 Nakano et al. ..... 227/8
2005/0023318 A1 * 2/2005 Aguirre et al. ..... 227/8
2005/0139628 A1 * 6/2005 Aguirre et al. ..... 227/8
2005/0205638 A1 * 9/2005 Wang ..... 227/8

* cited by examiner

*Primary Examiner*—Scott A. Smith
*Assistant Examiner*—Gloria R. Weeks

(57) ABSTRACT

A trigger switch structure of a nail driver is disclosed. The nail driver body comprises a nail driver body; a security device; one end of the security device being connected to the trigger device of the nail driver body; a trigger device: a trigger cover pivotally installed to the nail driver body; the trigger device being a U shape device; a driving sheet pivotally connected to the trigger cover and received in the trigger cover; a pivotal rod passing through the holes on the trigger cover and the driving sheet so as to fix the driving sheet to the trigger cover; and a switch; one end of the switch being formed with a ring; a stopper being extended downwards from the ring; a lower side of the stopper being formed with a recess; and the stopper protruded downwards between the ring and the recess being buckled to the block.

5 Claims, 5 Drawing Sheets

TRIGGER SWITCH STRUCTURE OF NAIL DRIVER

FIELD OF THE INVENTION

The present invention relates to nail drivers, and particularly to a trigger switch structure of a nail driver, wherein by adjusting the position of the switch with respect to the position of the handle, the moving length of the trigger cover can be adjusted. The operation of the switch can be performed quickly. Thereby by the position of the switch, the triggering states of the nail driver body can be identified.

BACKGROUND OF THE INVENTION

Referring to FIGS. 5 to 8, the prior art triggering switching device of a nail driver is illustrated. In switching the triggering mode of the prior art triggering switching device, a press end 91 aside the trigger 90 is pressed so that a rotation end 92 protrudes from another side for moving the rotation end 92. An eccentric shaft 920 above the rotation end 92 moves a trigger sheet 92 to move upwards or downwards for determining a first trigger portion 930 or a second triggering portion 931 to trigger a nail beating switch (not shown) behind the trigger 90. The first triggering portion 930 is near the trigger switch and the second triggering portion 931 is farther from the trigger switch so as to control the continuous beating or sequential beating of the nail.

However, the prior art has the following disadvantages.

In the prior art triggering switching device, one hand is used to press the press end and another end is used to rotate the rotation end for switching between the modes of sequential beating a nail and the continuous beating a nail. The operation is performed by two hands. The user must place the nail driver to a table or ground surface, otherwise it is difficult to perform the operation. However, the operation is not a design of personality.

The structure of the prior art triggering switching device is very complicated and many small round cylinder elements are used, which is unbeneficial to the assembly work. Thereby, the elements are easy to lose so as to affect the manufacturing speed and cost. However, this is also a burden of the users.

SUMMARY OF THE INVENTION

Accordingly, the primary object of the present invention is to provide a trigger switch structure of a nail driver, wherein by adjusting the position of the switch with respect to the position of the handle. The moving length of the trigger cover can be adjusted. The operation of the switch can be performed quickly. Thereby by the position of the switch, the triggering states of the nail driver body can be identified.

To achieve above objects, the present invention provides a trigger switch structure of a nail driver. The nail driver body comprises a nail driver body; a security device; one end of the security device being connected to the trigger device of the nail driver body; a trigger device: a trigger cover pivotally installed to the nail driver body; the trigger device being a U shape device; a driving sheet pivotally connected to the trigger cover and received in the trigger cover; a pivotal rod passing through the holes on the trigger cover and the driving sheet so as to fixed the driving sheet to the trigger cover; and a switch; one end of the switch being formed with a ring; a stopper being extended downwards from the ring; a lower side of the stopper being formed with a recess; the penetrating pivotal rod of the driving sheet being received in the recess; the stopper protruded downwards between the ring and the recess being buckled to the block on end surface of the trigger cover.

The various objects and advantages of the present invention will be more readily understood from the following detailed description when read in conjunction with the appended drawing.

BRIEF DESCRIPTION OF THE DRAWINGS

FIG. 3-1 is a partial schematic view of the trigger switch structure of a nail driver of the present invention.

FIGS. 3-2 and 3-3 are partial operation view of the trigger switch structure of a nail driver of the present invention.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
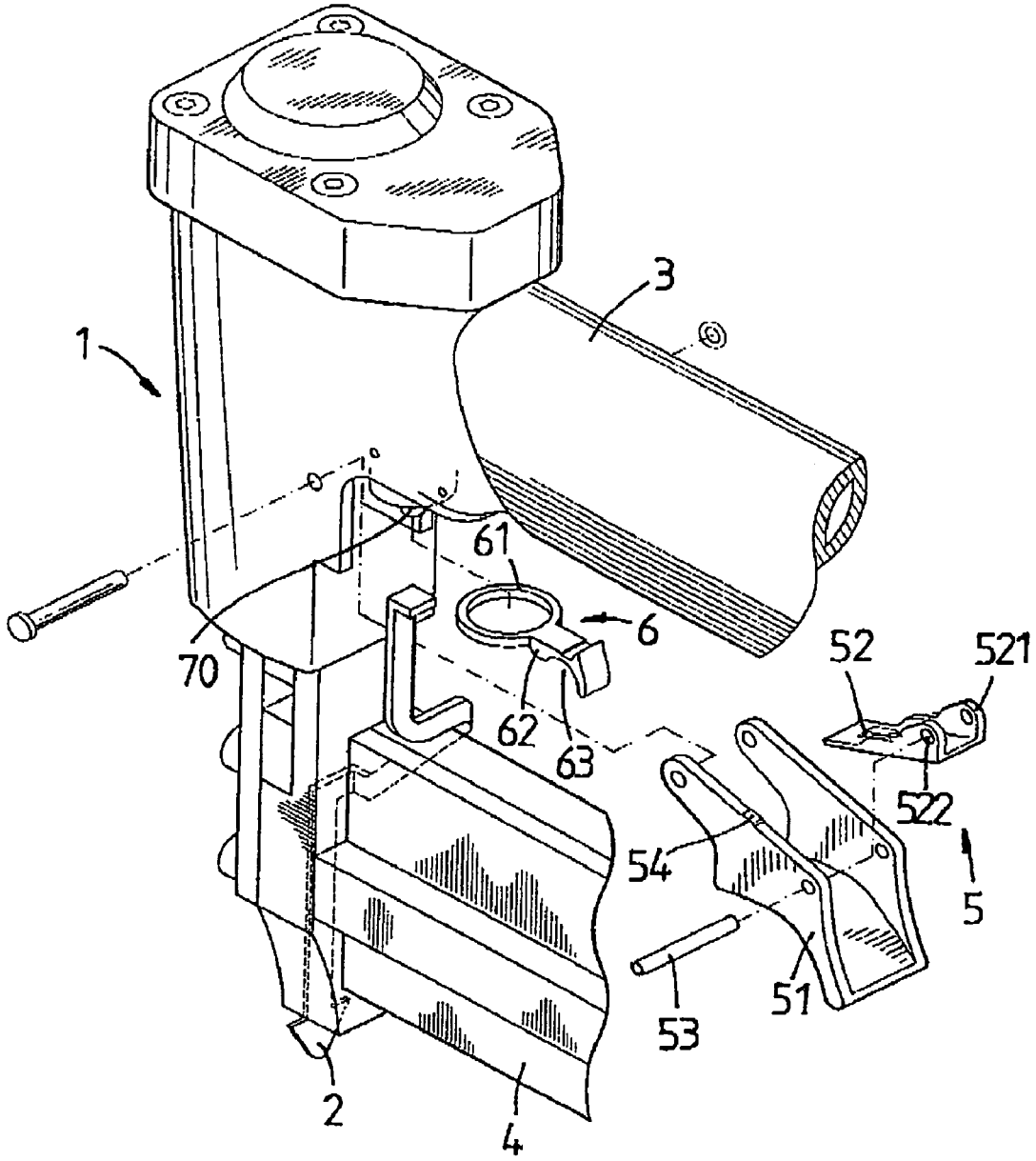
FIG. 1 is an exploded schematic view of the trigger switch structure of a nail driver of the present invention.

With reference to FIG. 1, the switching structure of a nail driver of the present invention is illustrated. The present invention includes a nail driver body 1, a security device 2, a handle 3, a nail cartridge 4, a trigger device 5, and a switch 6.

One end of the security device 2 is connected to the trigger device 5 of the nail driver body 1.

The trigger device 5 is formed by the following element:

A trigger cover 51 is pivotally installed to the nail driver body 1. The trigger device 5 is a U shape device.

A driving sheet 52 is pivotally connected to the trigger cover 51 and is received in the trigger cover 51. Two sides of a distal end of the driving sheet 52 are formed with symmetrical ear portions 521. Each ear portion 521 is formed with a penetrating hole 522. A pivotal rod 53 passes through the holes on the trigger cover 51 and the penetrating holes 522 of the driving sheet 52 so as to fix the driving sheet 52 to the trigger cover 51.

One end of the switch 6 is formed with a ring 61. A stopper 62 is extended downwards from the ring 61. A lower side of the stopper 62 is formed with a recess 63. The ring 61 is rotatable installed to the nail driver body 1. The penetrating pivotal rod 53 of the driving sheet 52 is received in the recess 63. The stopper 62 protruded downwards between the ring 61 and the recess 63 is buckled to the block 54 on end surface of the trigger cover 51.

In assembly, the ring 61 is pivotally installed to the nail driver body 1. Then the pivotal rod 53 serves to pivotally install the trigger cover 51 with the driving sheet 52. Then, a positioning pin serves to pivotally install the trigger cover 51 to the nail driver body 1 (see FIG. 2).

Figures 1, 3:
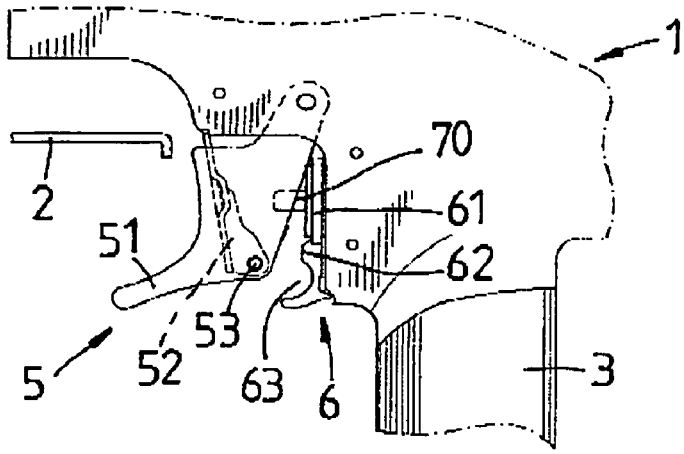
Figures 2, 3:
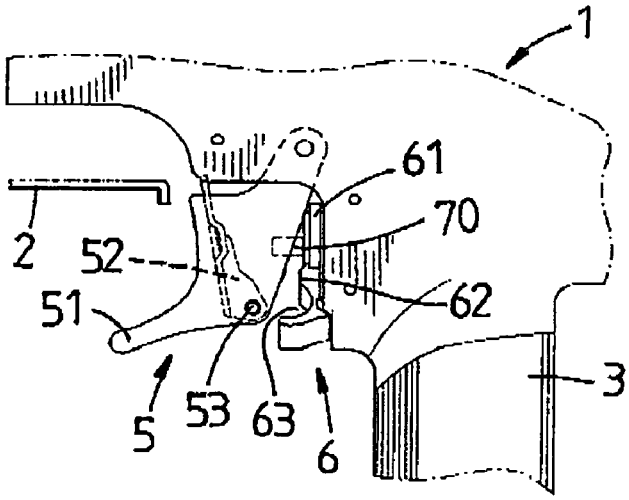
Figure 3:
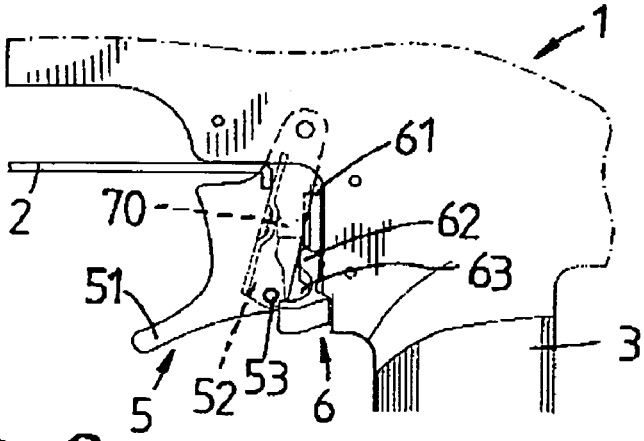
Figure 4:
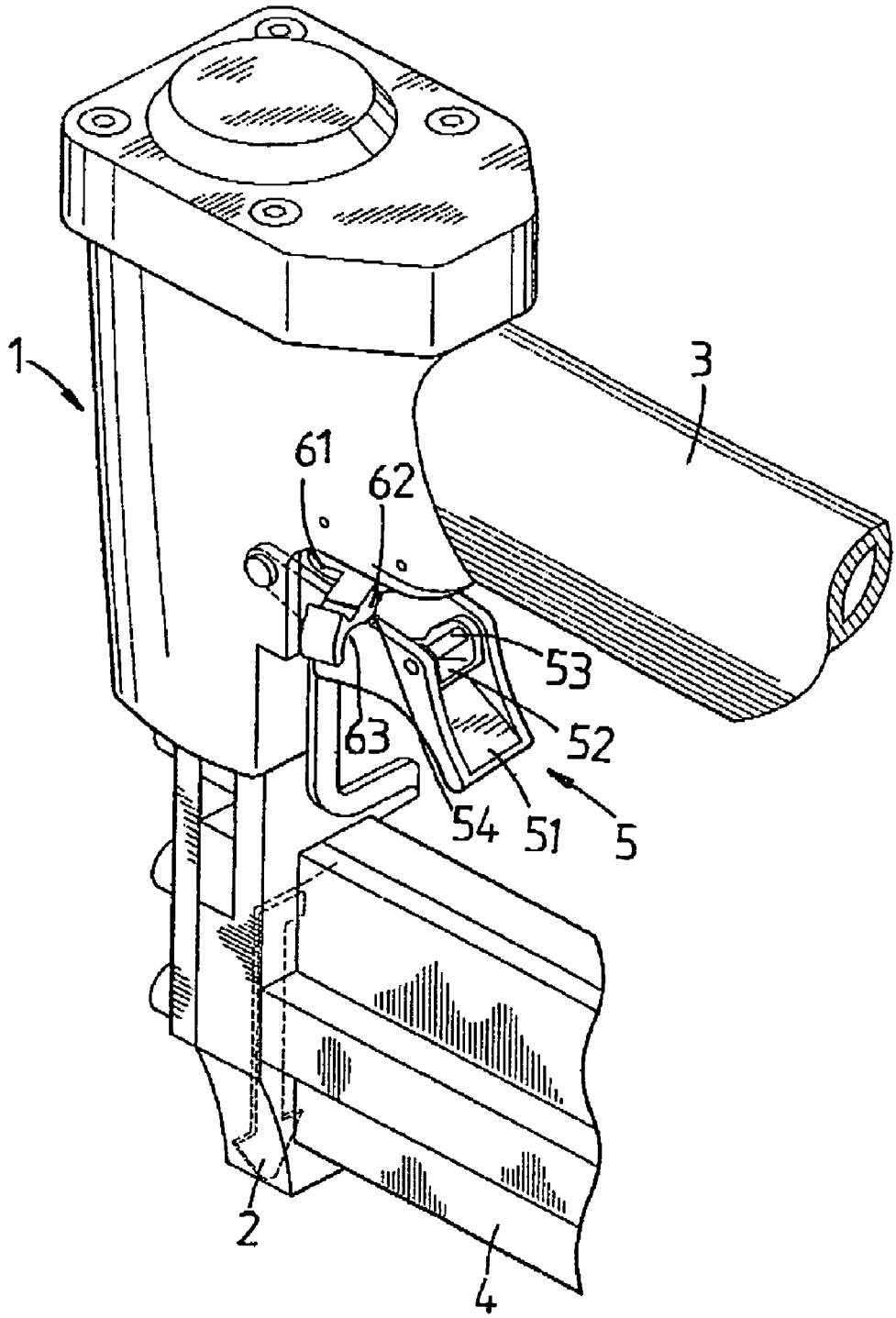
FIG. 4 is a schematic view showing the operation of the trigger switch structure of a nail driver of the present invention.
Figure 5:
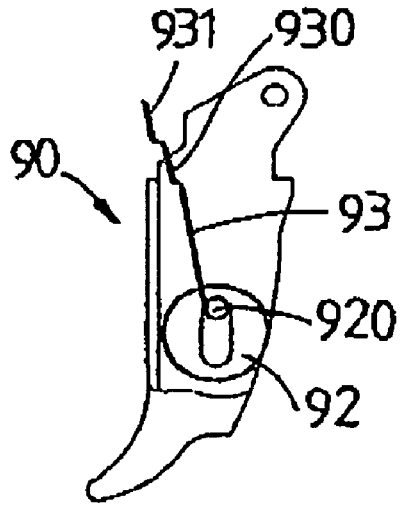
FIG. 5 (PRIOR ART)
FIG. 5 is a cross sectional view showing the sequential trigger state of the trigger switch structure of a prior art nail driver.
Figure 6:
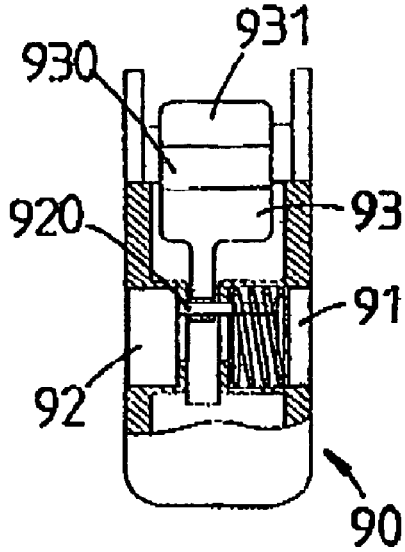
FIG. 6 (PRIOR ART)
FIG. 6 is a cross sectional view showing the sequential trigger state of the trigger switch structure of a prior art nail driver.
Figure 7:
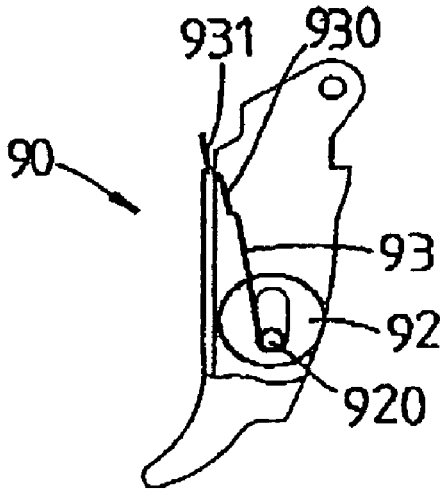
FIG. 7 (PRIOR ART)
FIG. 7 is a cross sectional view showing the continuous trigger state of the trigger switch structure of a prior art nail driver.
Figure 8:
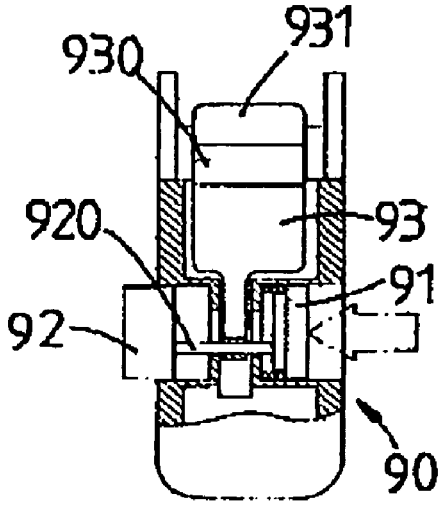
FIG. 8 (PRIOR ART)
FIG. 8 is a cross sectional view showing the continuous trigger state of the trigger switch structure of a prior art nail driver.

If the user desires to trigger the nail driver sequentially, as shown in FIG. 3-1, the switch 6 is adjusted to be parallel to the handle 3. Thereby when the security device 2 resists against a work piece, the security device 2 displaces to reject the driving sheet 52 so that the security device 2 moves backwards to eject the driving sheet 52 so that the driving sheet 52 moves backwards. Then, the trigger cover 51 is pressed. Since one end of the U shape trigger cover 51 is opened, the trigger cover 51 can be completely pressed to the extreme position and the driving sheet 52 is triggered to touch the nail beating rod 70 of the nail driver body 1. Thus the nail is beaten sequentially.

Figure 2:
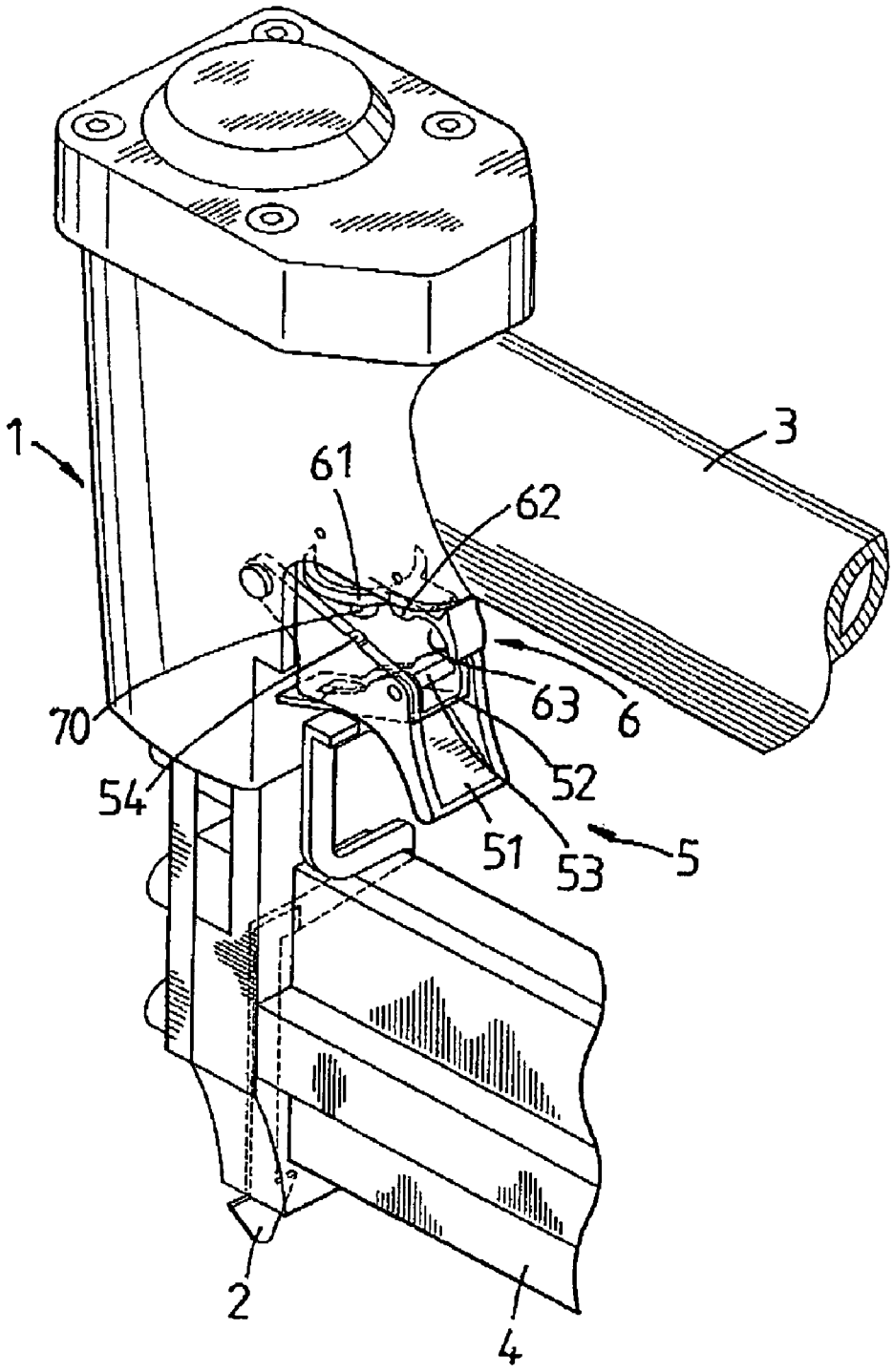
FIG. 2 is a schematic perspective view of the trigger switch structure of a nail driver of the present invention.

Furthermore, when the user desires to beat a nail continuously. The switch 6 is rotated to have an angle with the handle 3, as shown in FIG. 3-2. Then the user presses the trigger cover 5 1, the protruded stopper 62 of the switch 6 will buckle the block 54 of the trigger cover 51 at a shorter distance (see 3-3) than the condition illustrated in FIG. 3-1. Next, it is only necessary to use the security device 2 in front of the nail driver body 1 to continuously resist against the work piece. Furthermore, the nail can be beaten continuously.

Moreover, in the present invention, by adjusting the position of the switch 6 with respect to the position of the handle 3. The moving length of the trigger cover 51 can be adjusted. The operation of the switch can be performed quickly. Thereby by the position of the switch, the triggering states of the nail driver body 1 can be identified.

Furthermore, in the present invention, the switch 6 is made by plastic molding. The machining work is easy and rapid with a lower cost. Furthermore, the structure will not increase the weight and space of the nail driver, however it can provide the function of sequential operation and continuous operation.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A trigger switch structure of a nail driver comprising:

a nail driver body;

a security device;

a trigger device; one end of the security device being connected to the trigger device of the nail driver body; the trigger device comprising:

a trigger cover pivotally installed to the nail driver body; the trigger device being a U shape device; and a driving sheet pivotally connected to the trigger cover and received in the trigger cover; a pivotal rod passing through the holes on the trigger cover and the driving sheet so as to fixed the driving sheet to the trigger cover; and a switch; one end of the switch being formed with a ring; a stopper being extended downwards from the ring; a lower side of the stopper being formed with a recess; the penetrating pivotal rod of the driving sheet being received in the recess; wherein the portion of the stopper between the ring and the recess is capable of being buckled to an edge/end surface of the trigger cover.

2. The trigger switch structure of a nail driver as claimed in claim 1, wherein a cartridge for receiving nails is installed in the nail driver body.

3. The trigger switch structure of a nail driver as claimed in claim 1, wherein the ring of the switch is rotatably installed to the nail driver body.

4. The trigger switch structure of a nail driver as claimed in claim 1, wherein the switch is made of plastics.

5. The trigger switch structure of a nail driver as claimed in claim 1, wherein each car portion is formed with a penetrating hole; a pivotal rod passes through the holes on the trigger cover and the penetrating holes of the driving sheet so as to fix the driving sheet to the trigger cover.

* * * * *